US008528881B2

(12) United States Patent
Dellinger

(10) Patent No.: US 8,528,881 B2
(45) Date of Patent: Sep. 10, 2013

(54) PAN PULLER FOR REMOVING FORMING PANS BETWEEN JOISTS OF A CONCRETE FLOOR

(75) Inventor: Christopher Anthony Dellinger, The Woodlands, TX (US)

(73) Assignee: T.A.S. Commercial Concrete Construction, LLC, Houston, TX (US)

( * ) Notice: Subject to any disclaimer, the term of this patent is extended or adjusted under 35 U.S.C. 154(b) by 539 days.

(21) Appl. No.: 12/794,241

(22) Filed: Jun. 4, 2010

(65) Prior Publication Data

US 2011/0297902 A1 Dec. 8, 2011

(51) Int. Cl.
*B21F 9/00* (2006.01)

(52) U.S. Cl.
USPC ..... 254/199

(58) Field of Classification Search
USPC ..... 254/199, 241
See application file for complete search history.

(56) References Cited

U.S. PATENT DOCUMENTS

| | | | | |
|---|---|---|---|---|
| 1,509,253 | A * | 9/1924 | Phelps | 249/32 |
| 2,954,596 | A * | 10/1960 | Fassauer et al. | 425/62 |
| 7,108,449 | B1 * | 9/2006 | Allen et al. | 404/75 |
| 7,131,239 | B2 * | 11/2006 | Williams | 52/169.5 |
| 2004/0050001 | A1 * | 3/2004 | Williams | 52/292 |

* cited by examiner

*Primary Examiner* — Emmanuel M Marcelo
(74) *Attorney, Agent, or Firm* — Conley Rose, P.C.

(57) ABSTRACT

A system for removing a forming pan from a concrete slab having integral joists. In some embodiments, the system includes a forklift powered by a power supply; and a pan puller supported thereon. The pan puller includes a motor receiving power from the power supply, a wheel driven to rotate by the motor, the wheel having a plurality of teeth adapted to engage and remove the forming pan from the joint, and a basket configured to receive and contain the removed forming pan.

20 Claims, 6 Drawing Sheets

PAN PULLER FOR REMOVING FORMING PANS BETWEEN JOISTS OF A CONCRETE FLOOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates to concrete joist systems created with standard forming pans. More particularly, the disclosure relates an apparatus for stripping the pans from the concrete joist system once formed.

Pan joist construction refers to a method of constructing a floor system having a ribbed slab using standard forming pans. During construction, a frame for the floor is initially installed. The frame includes a plurality of spaced forming pans. Each forming pan functions as a mold for the creation of a void. Each pair of adjacent forming pans enables the formation of a joist therebetween. Concrete is then poured into the frame between and over the forming pans to create a slab with integrally formed joists. After the concrete sets, the frame and forming pans are removed.

Typically the forming pans are removed manually. This process involves one or more individuals prying each pan from the ribbed slab using a pry bar, or other similar device. Once freed from the slab, the forming pan is collected for reuse. Because pan removal is performed manually, this process can significantly increase the time required to construct the floor system. Moreover, pan removal is fraught with safety concerns due to the amount of force that must be applied to pry the forming pans loose.

Accordingly, there is a need for an apparatus that enables pan removal at a faster rate than that possible using conventional manual methods and with minimal human involvement.

SUMMARY OF THE EMBODIMENTS

An apparatus for removing a forming pan from a concrete slab having integral joists is disclosed. The apparatus is referred to herein as a pan puller. In some embodiments, the pan puller includes a rotatable wheel having a plurality of teeth adapted to engage and remove the forming pan from the slab due to rotation of the wheel and a basket coupled thereto, the basket adapted to receive and contain the removed forming pan.

In some system embodiments for removing the forming pan from the concrete slab, the system includes a forklift powered by a power supply and a pan puller supported thereon. The pan puller includes a motor receiving power from the power supply, a wheel driven to rotate by the motor, the wheel having a plurality of teeth adapted to engage and remove the forming pan from the joint, and a basket configured to receive and contain the removed forming pan.

In some method embodiments for removing the forming pan from the concrete slab, the method includes rotating a wheel having a plurality of teeth, engaging the forming pan with at least one of the teeth, and removing the forming pan from the slab. The method may further include positioning a basket proximate the wheel and receiving the removed forming pan in the basket.

Thus, embodiments described herein comprise a combination of features and characteristics intended to address various shortcomings associated with conventional methods for stripping forming pans from an installed concrete floor system. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
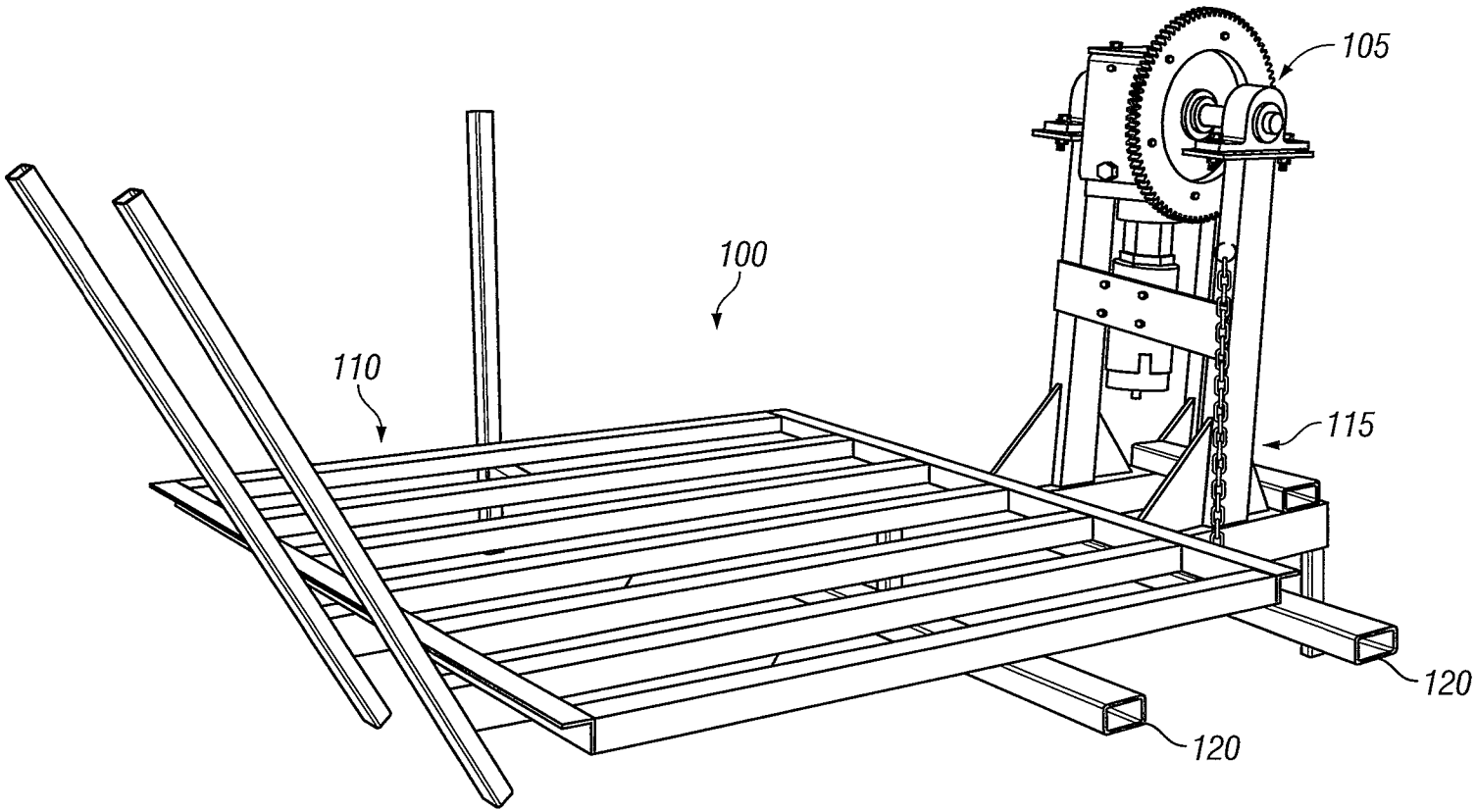
FIG. 1 is a perspective view of an embodiment of a pan puller in accordance with the principles disclosed herein.

The following description is directed to exemplary embodiments of a pan puller and associated methods. The embodiments disclosed should not be interpreted, or otherwise used, as limiting the scope of the disclosure, including the claims. One skilled in the art will understand that the following description has broad application, and that the discussion is meant only to be exemplary of the described embodiment, and not intended to suggest that the scope of the disclosure, including the claims, is limited to that embodiment.

Certain terms are used throughout the following description and the claims to refer to particular features or components. As one skilled in the art will appreciate, different persons may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to the central or longitudinal axis.

Referring now to FIG. 1, there is shown a perspective view of a pan puller 100 in accordance with the principles disclosed herein. As will be described, pan puller 100 enables removal and containment of forming pans used to create concrete a concrete slab floor with integral joists. Pan puller 100 includes a pan stripper assembly 105, a pan catcher assembly 110, and a stripper support assembly 115.

In some embodiments, including the illustrated embodiment, pan puller 100 further includes two forklift guides 120. As shown, forklift guides 120 extend substantially parallel to one another below stripper support assembly 115 and pan catcher assembly 110. Each forklift guide 120 is tubular, enabling the fork of a forklift to be received therein. With forks inserted into guides 120, pan puller 100 may then be moved by the forklift to a desired location and supported while pan puller 100 is utilized to remove forming pans from the ribbed slab.

Figure 2:
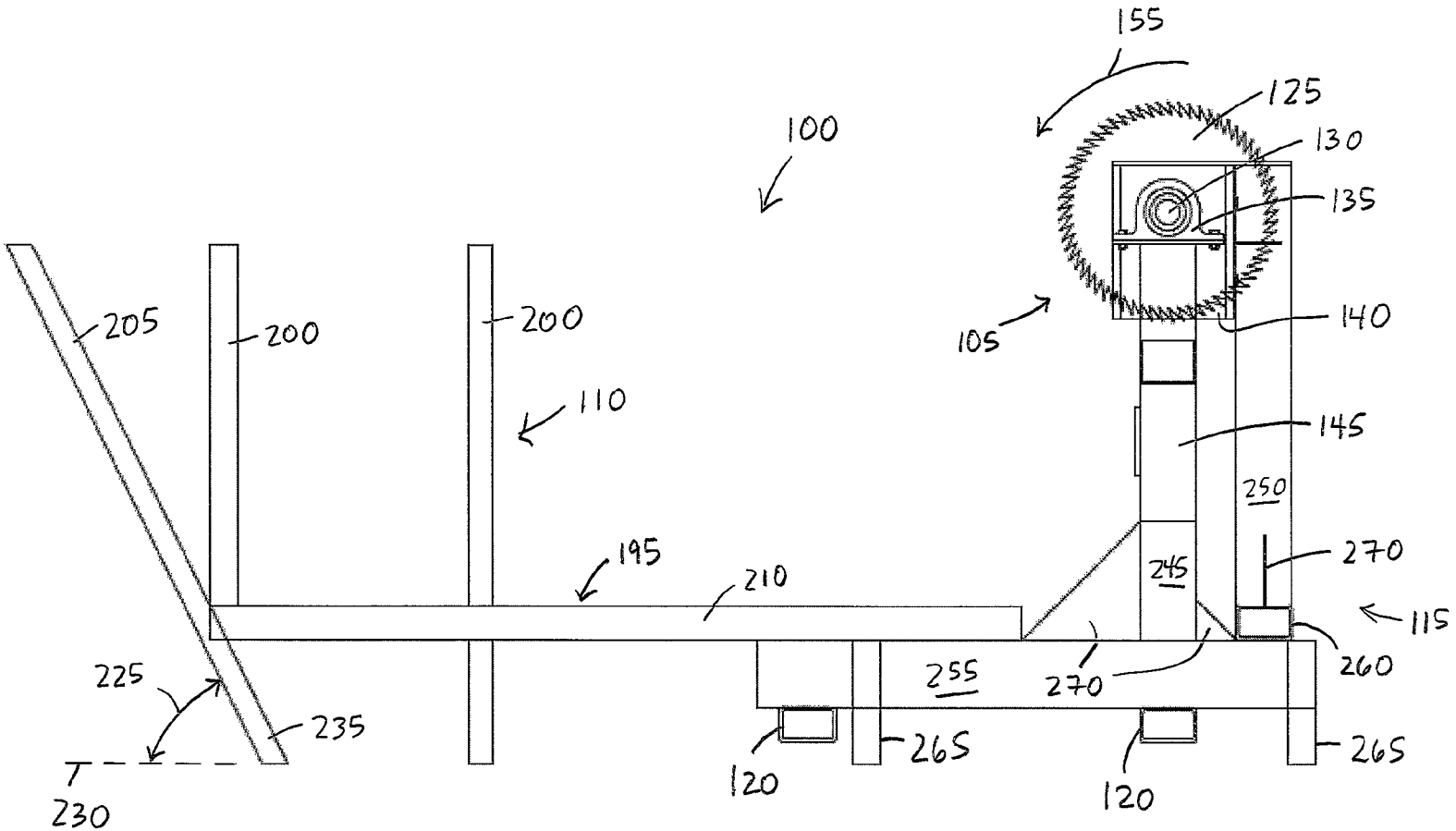
FIG. 2 is a schematic side view of the pan puller of FIG. 1.
Figure 3:
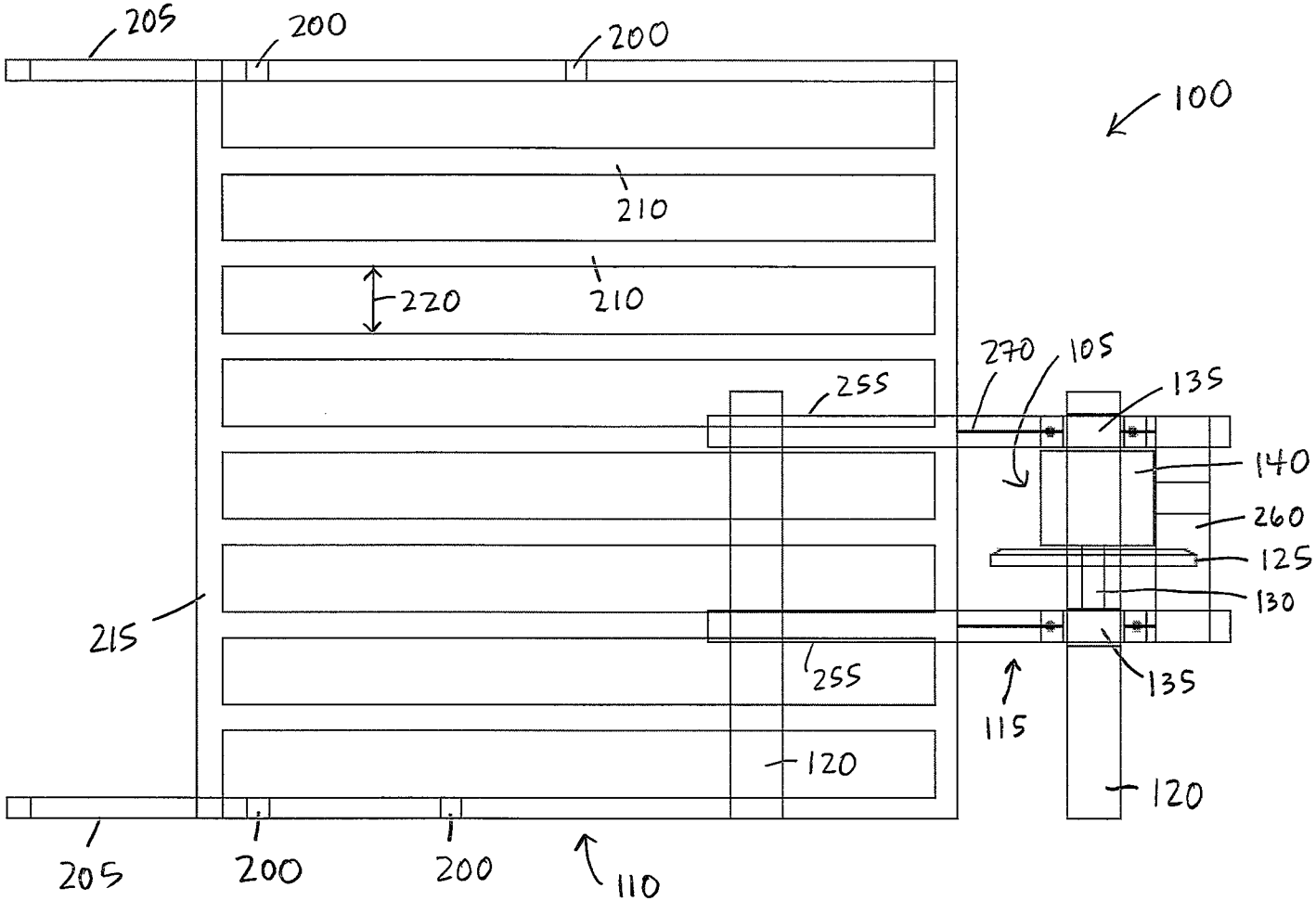
FIG. 3 is a schematic top view of the pan puller of FIG. 1.
Figure 4:
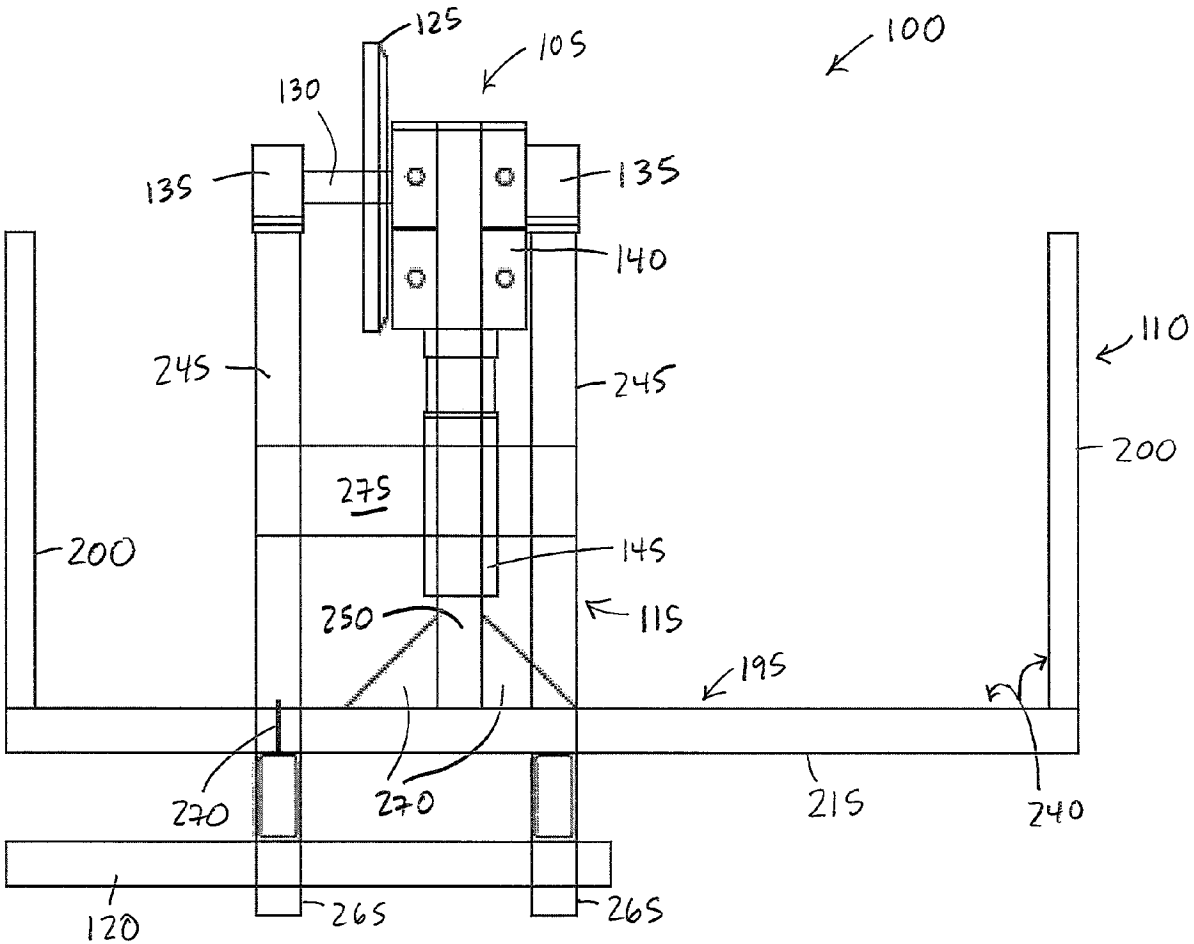
FIG. 4 is a schematic end view of the pan puller of FIG. 1.

Pan stripper assembly 105 enables removal of the forming pans from the ribbed slab. As shown in FIGS. 2 through 4, pan stripper assembly 105 includes a stripper wheel 125, a wheel shaft 130, two bearings 135, a gearbox 140, and a motor 145. Wheel shaft 130 is cylindrical in shape and has two opposing ends, each end supported by one bearing 135. Shaft 130 is rotatable relative to bearings 135 in a direction 155, best illustrated in FIG. 2. Stripper wheel 125 is coupled about shaft 130 and rotatable with shaft 130.

Motor 145 is an electric DC motor and preferably powered by the same source which powers the forklift supporting pan puller 100. Gearbox 140 is coupled mechanically between motor 145 and shaft 130 and electrically coupled to motor 145. The combination of motor 145 and gearbox 140 provides desired levels of rotational speed and torque to shaft 130, and thus stripper wheel 125. In some embodiments, the combination of motor 145 and gearbox 140 rotates shaft 130 at a speed of approximately 5 revolutions per minute (RPM) with up to 1,400 ft-lbs of torque. Further, in some embodiments, motor 145 is a 12 volt DC motor manufactured by Baldor Electric Company, headquartered at 5711 R. S. Boreham, Jr. Street, Fort Smith, Ark. 72901. Also, gearbox 140 is a K Series, Right Angle Helical/Bevel gear drive manufactured by Stober Drives Inc., a division of Stober Antriebstechnik GmbH, headquartered in Pforzhiem, Germany.

Figure 5:
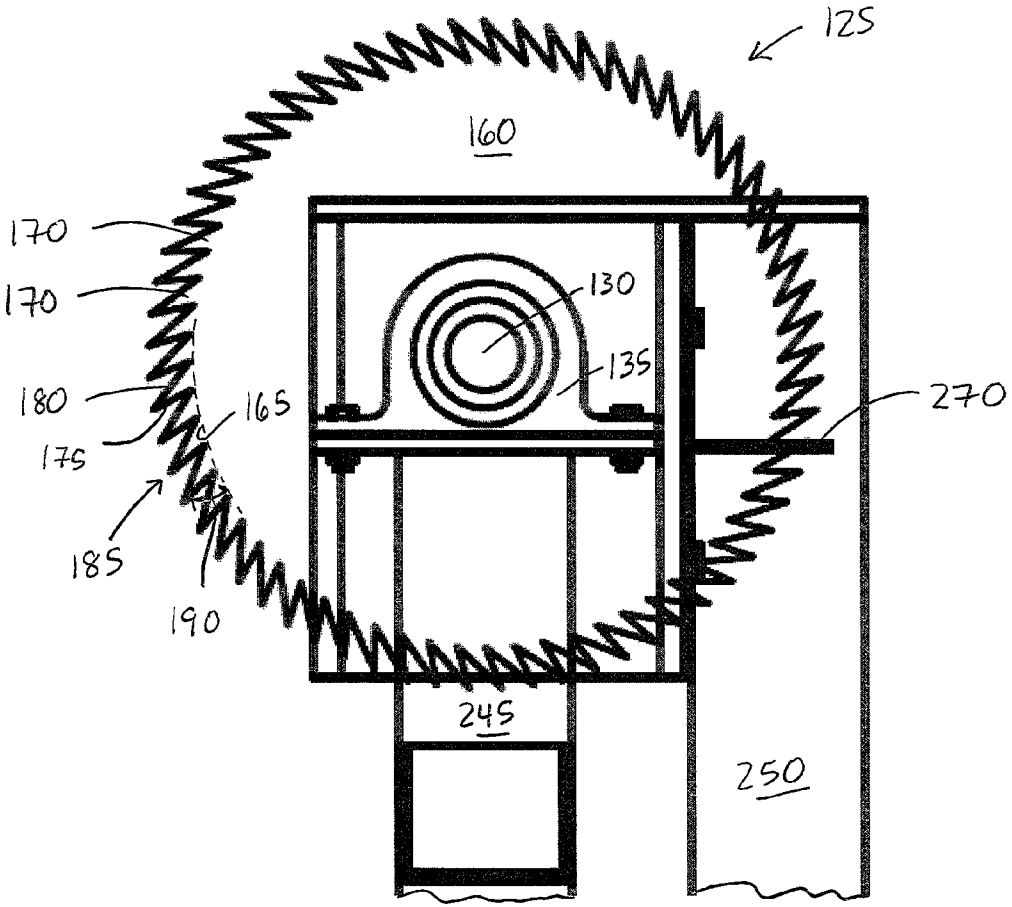
FIG. 5 is an enlarged view of the stripper wheel of FIG. 2.

As best viewed in FIG. 5, stripper wheel 125 has a circular body 160 with an outer surface 165 and a plurality of teeth 170 extending therefrom. In some embodiments, body 160 and teeth 170 are integral, formed from a single piece of material by methods such as but not limited to laser cutting. Each tooth 170 has a front face 175, a rear face 180, both faces 175, 180 defined with respect to rotation direction 155, and a tip 185 located therebetween. The angle 190 between outer surface 165 of body 160 and front face 175 of tooth 170 is preferably acute. This enables tips 185 of teeth 170 to engage or "catch" an edge of an installed forming pan when wheel stripper 125 rotates in direction 155. Once engaged with, or caught on, the forming pan, stripper wheel 125 has sufficient torque to pull and remove the forming pan from the ribbed slab.

Referring again to FIGS. 2 through 4, pan catch assembly 110 receives and contains the forming pan once removed by pan stripper assembly 105. In the illustrated embodiment, pan catch assembly 110 includes a pan 195 with a plurality of vertical and angled posts 200, 205, respectively, coupled thereto. Pan 195 includes a plurality of horizontally-extending posts 210 coupled between two posts 215 extending normally thereto. Posts 210 are positioned relative to each other such that the spacing 220 between each pair of adjacent posts 210, best viewed in FIG. 3, is too small to allow a forming pan to pass therebetween, thus preventing the forming pans from falling through pan 195 and posing a safety hazard during operation of pan puller 100.

Vertical posts 200 are coupled to the outermost posts 210 of pan 195 and extend substantially normally relative to the outermost posts 210. Angled posts 205 are coupled to the post 215 distal pan stripper assembly 105 and extend at an angle 225 relative to a horizontal plane 230. Pan 195 with posts 200, 205 coupled thereto form a basket 240 with pan 195 functioning as the base or bottom of basket 240 and posts 200, 205 defining sides of basket 240 extending upward its base. Basket 240 receives and contains the forming pans once removed from the ribbed slab by pan stripper assembly 105. Further, each post 205 has a lower end, or foot, 235 that enables pan puller 100 to be positioned on the ground in a stable orientation when not in use.

Stripper support assembly 115 supports pan stripper assembly 105 such that wheel stripper 125 is positioned at the proper location relative to pan catch assembly 110. In the illustrated embodiment, stripper support assembly 115 includes two shaft support members 245, a motor support member 250, three coupling members 255, 260, and at least four supports or feet 265. Shaft support members 245 extend substantially vertically, each support member 245 coupled to and supporting one bearing 135 and an end of shaft 130 inserted therein. Together support members 245 support bearings 135, shaft 130, and stripper wheel 125. Similarly, motor support member 250 extends substantially vertically to support motor 145 and gearbox 140 with gearbox 140 coupled to the upper end of member 250 and motor 145 suspended below gearbox 140, as shown.

Coupling members 255, 260 enable coupling of support members 240, 245 to basket 240 such that basket 240 is able to receive forming pans removed by stripper wheel 125. In this embodiment, coupling members 255 extend substantially parallel to each other and are coupled between the lower end of one shaft support member 245 and basket 240. Member 260 extends substantially normally between members 255 and is coupled to the lower end of motor support member 250.

When present, forklift guides 120 are coupled to coupling members 255 such that guides 120 extend substantially normally to members 255 and straddle the center of gravity of pan puller 100. This enables pan puller 100 to remain in a stable orientation when raised by a forklift. Feet 265 are coupled to members 255 and extend vertically downward therefrom. Feet 265 of stripper support assembly 115 and feet 235 of pan catcher assembly 110 enable pan puller 100 to be positioned on the ground in a stable and substantially horizontal orientation when not in use.

During operation of pan puller 100, stripper wheel 125 experiences loads due to engagement of teeth 170 with the forming pans. The loads are transferred through stripper wheel 125 to other components of pan puller 100. To enable pan puller 100 to withstand these loads without excessive deformation and remain both stable and operational, pan puller 100 further includes a plurality of flanges 270 and bracing 275 that provide additional support to components previously described.

In the illustrated embodiment, two flanges 270 are coupled between motor support member 250 and coupling member 260 to strengthen the connection between members 250, 260 and prevent excessive deformation of member 250 relative to member 260 due to loads from wheel stripper 125. Additional flanges 270 are similarly coupled between shaft support members 245 and coupling members 255 and between motor support member 250 and gearbox 140. Bracing 275, best viewed in FIG. 4, is coupled between shaft support members 245 just below motor 145 to further stabilize members 245.

Figure 6:
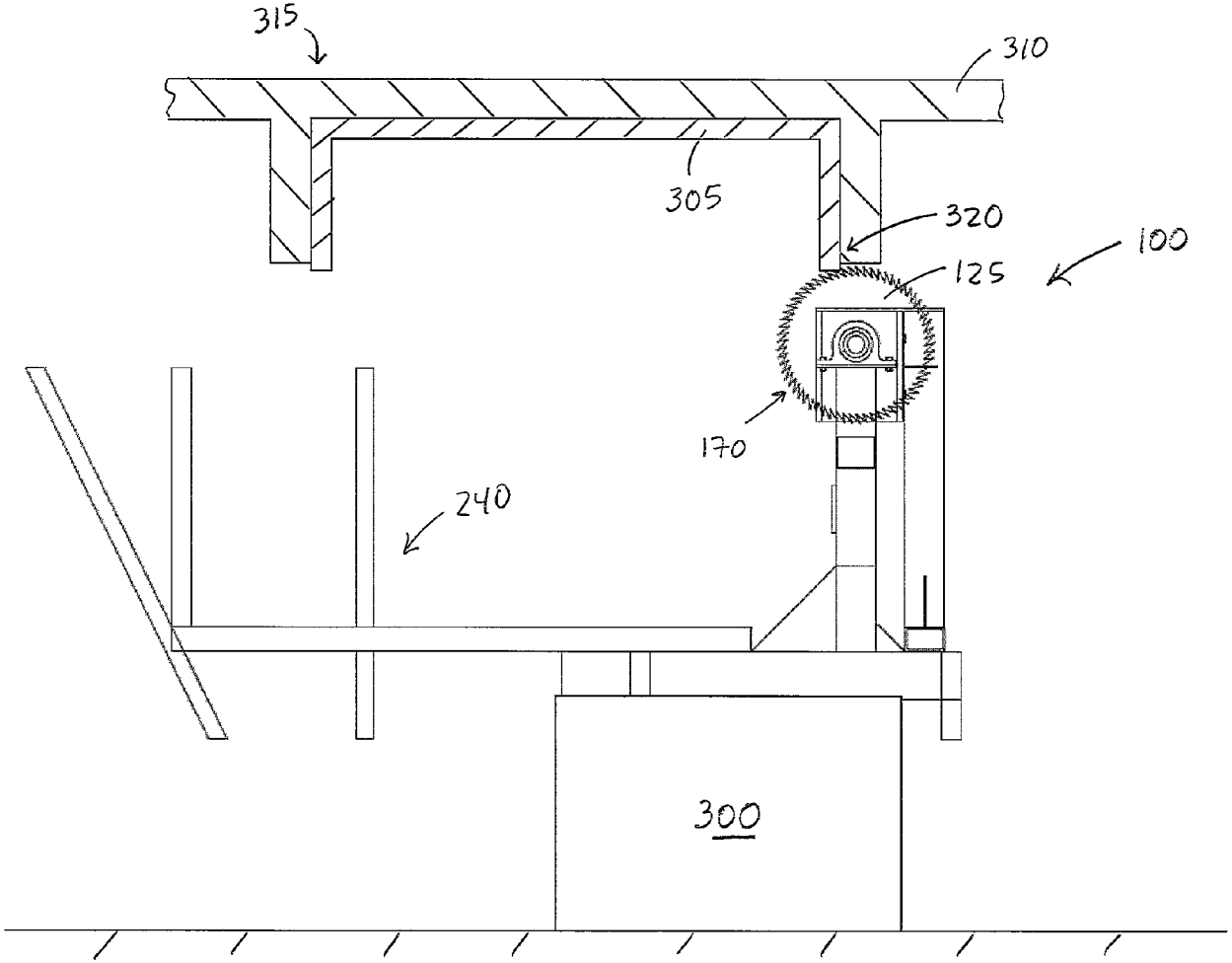
FIG. 6 is a schematic representation of the pan puller of FIG. 1 stripping a forming pan from a concrete floor system.

Referring finally to FIG. 6, prior to operation of pan puller 100, forks of a forklift 300, represented schematically, are inserted into forklift guides 120 of pan puller 100, and motor 145 is connected to a power source. Preferably, the power source is that also powering forklift 300. In some embodiments, the forklift power supply is a battery located on forklift 300. Thus, the battery powers both forklift 300 and pan puller 100. Pan puller 100 is then moved by forklift 300 to a desired position proximate a forming pan 305 to be removed from a ribbed slab 310 of a floor system 315.

When in the desired position, pan puller 100 is actuated to rotate stripper wheel 125. As stripper wheel 125 rotates, forklift 300 is moved closer to forming pan 305 to enable teeth 170 (FIG. 5) of stripper wheel 125 to engage or "catch" an edge 320 of forming pan 305 and pull pan 305 from ribbed slab 310. Once free of slab 310, forming pan 305 falls into basket 240 where it remains until forming pan 305 may be removed from basket 240 for storage and/or reuse. After forming pan 305 is safely received in basket 240, pan puller 100 is repositioned beneath the next forming pan to be removed, and the removal process is repeated. When basket 240 is full, pan puller 100 may be relocated to enable basket 240 to be emptied.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. An apparatus for removing a forming pan from a concrete slab having integral joists, the apparatus comprising:
- a rotatable wheel comprising a plurality of teeth configured to directly engage and pull the forming pan from the slab; and
- a basket coupled to the wheel, the basket configured to receive and contain the forming pan.

2. The apparatus of claim 1, further comprising a rotatable shaft extending through the wheel.

3. The apparatus of claim 2, further comprising a motor and a gearbox coupled to the shaft.

4. The apparatus of claim 2, further comprising two vertically extending support members, each support member supporting an end of the shaft, and two horizontally extending coupling members, each coupling member connected between one support member and the basket.

5. The apparatus of claim 4, further comprising two tubular guides coupled to the coupling members and adapted to receive forks of a forklift, whereby the apparatus is moveable by the forklift.

6. The apparatus of claim 4, further comprising bracing coupled between the vertically extending support members.

7. The apparatus of claim 4, further comprising one or more stiffening flanges coupled between one of the vertically extending support members and one of the horizontally extending coupling members.

8. The apparatus of claim 1, wherein the wheel comprises an outer surface from which the teeth extend; and wherein each tooth has a front face defined relative to a direction in which the wheel rotates and oriented such that an angle between the front face and the outer surface is acute.

9. The apparatus of claim 1, wherein the basket comprises a plurality of horizontally extending posts and a plurality of vertically extending posts coupled thereto.

10. The apparatus of claim 9, wherein each adjacent pair of the horizontally extending posts are spaced apart a distance through which the forming pan cannot pass.

11. A system for removing a forming pan from a concrete slab having integral joists, the system comprising:
- a forklift powered by a power supply; and
- a pan puller supported thereon, the pan puller comprising:
  - a motor receiving power from the power supply;
  - a wheel driven to rotate by the motor, the wheel comprising a plurality of teeth adapted to engage and remove the forming pan from the joint; and
  - a basket configured to receive and contain the removed forming pan.

12. The system of claim 11, wherein the pan puller further comprises two tubular guides, each guide receiving therein a fork of the forklift.

13. The system of claim 11, wherein the wheel comprises an outer surface from which the teeth extend; and wherein each tooth has a front face defined relative to a direction in which the wheel rotates and oriented such that an angle between the front face and the outer surface is acute.

14. The system of claim 11, wherein the basket comprises:
- a plurality of horizontally extending posts, each adjacent pair of the horizontally extending posts spaced apart a distance through which the forming pan cannot pass; and
- a plurality of vertically extending posts coupled thereto.

15. The system of claim 11, further comprising:
- a rotatable shaft extending through the wheel; and
- a gearbox coupled between the motor and the shaft.

16. A method for removing a forming pan from a concrete slab having integral joists, the method comprising:
- (a) rotating a wheel comprising a plurality of teeth;
- (b) directly engaging the forming pan with at least one of the teeth during (a); and
- (c) pulling the forming pan from the slab with the rotating wheel during (b).

17. The method of claim 16, further comprising:
- positioning a basket proximate the wheel; and
- receiving the pulled forming pan in the basket.

18. The method of claim 17, further comprising:
- coupling at least one support member between the wheel and the basket; and
- lifting the support member with the wheel and the basket coupled thereto proximate the forming pan.

19. The method of claim 18, wherein lifting the at least one support member with the wheel and the basket coupled thereto comprises:
- inserting forks of a forklift into two tubular guides coupled to the support member; and
- raising the support member with the forklift.

20. The method of claim 19, wherein rotating the wheel comprises:
- coupling a motor and a gearbox to a rotatable shaft;
- extending the shaft through the wheel;
- providing power to the motor from a source also providing power to the forklift; and
- rotating the shaft with the motor and the gearbox.

* * * * *